United States Patent [19]

Taguchi et al.

[11] Patent Number: 4,959,643

[45] Date of Patent: Sep. 25, 1990

[54] DISPLAY UNIT HAVING AN IMPROVED EDITING INPUT CAPABILITY

[75] Inventors: Yasuhiro Taguchi; Hiroichi Yoshida, both of Yamatokoriyama, Japan

[73] Assignee: Sharp Kabushiki Kaisha, Osaka, Japan

[21] Appl. No.: 191,825

[22] Filed: May 9, 1988

Related U.S. Application Data

[63] Continuation of Ser. No. 816,858, Jan. 7, 1986, abandoned.

[30] Foreign Application Priority Data

Jan. 31, 1985 [JP] Japan ..... 60-18288

[51] Int. Cl.[5] ..... G09G 1/00

[52] U.S. Cl. ..... 340/721; 340/723

[58] Field of Search ..... 340/706, 721, 724, 723, 340/731; 364/521; 273/DIG. 28

[56] References Cited

U.S. PATENT DOCUMENTS 4,533,910 8/1985 Sukonick et al. ..... 340/724

4,789,962 12/1988 Berry et al. ..... 340/721

FOREIGN PATENT DOCUMENTS 0185845 8/1985 European Pat. Off. ..... 340/721

OTHER PUBLICATIONS

The Lisa Computer System by Gregg Williams, BYTE, Feb. 1983, pp. 33–50.

*Primary Examiner*—Jeffery A. Brier

*Attorney, Agent, or Firm*—Birch, Stewart, Kolasch & Birch

[57] ABSTRACT

A display unit includes a display area for displaying first and second data groups, a control circuit for dividing the display area into at least two portions when the first data group is displayed in the display area, a circuit for controlling a cursor to be displayed in the display area, a circuit for identifying a display portion that contains the cursaor, a circuit for selecting a particular portion that does not contain the cursor, according to the output from the identifying circuit, and a circuit for controlling the second data group to be displayed in the particular portion selected by the selecting circuit.

6 Claims, 1 Drawing Sheet

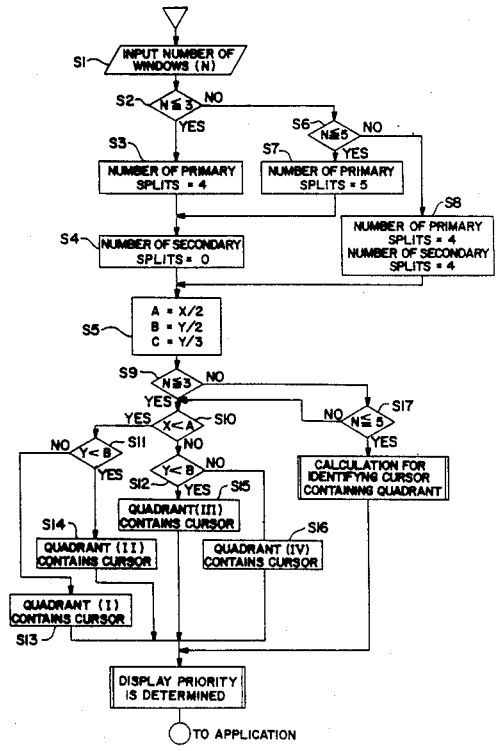

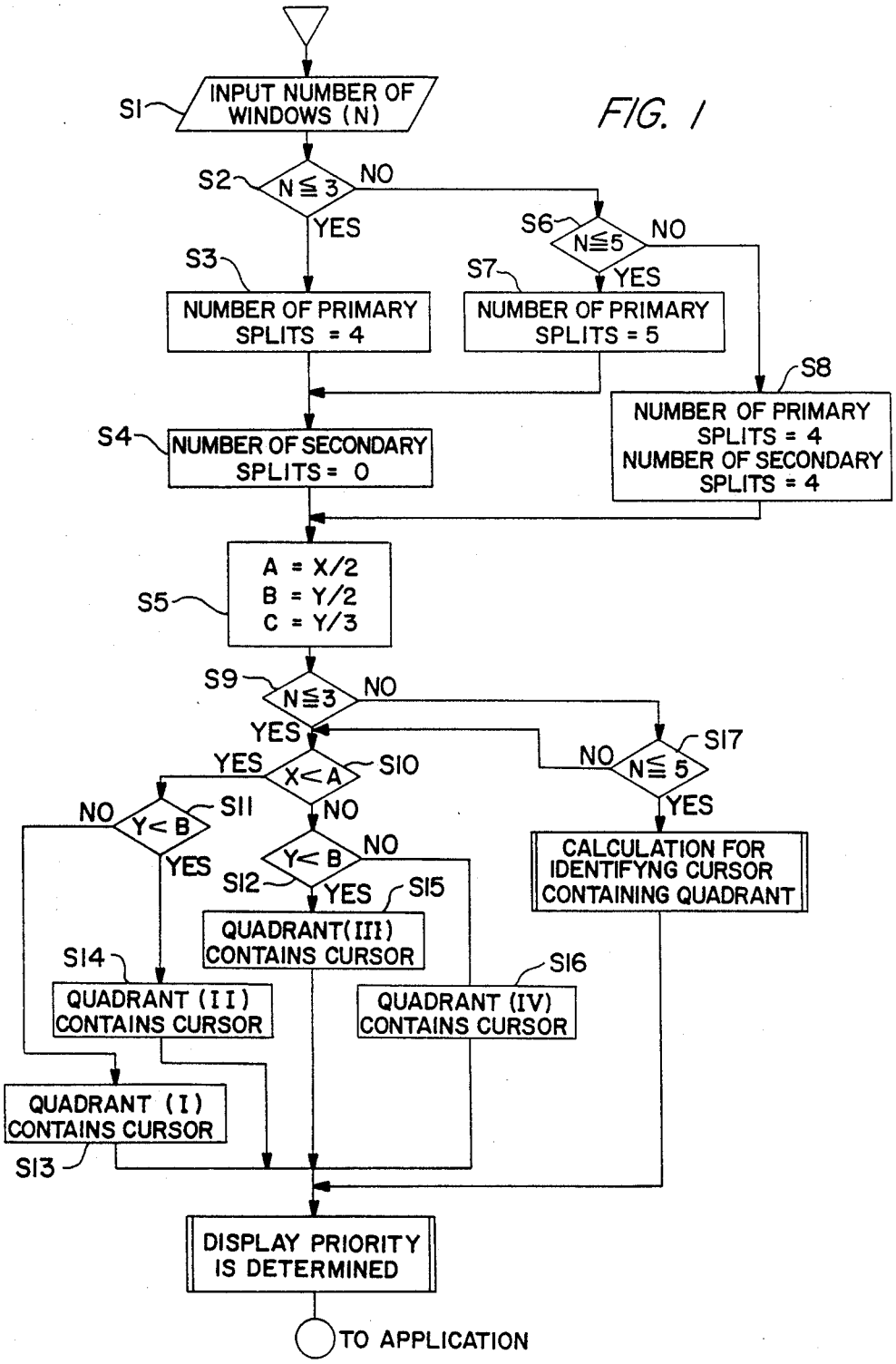
FIG. 1
S1
INPUT NUMBER OF WINDOWS (N)
S2
N≦3
NO
YES
S3
NUMBER OF PRIMARY SPLITS = 4
S6
N≦5
NO
YES
S7
NUMBER OF PRIMARY SPLITS = 5
S8
NUMBER OF PRIMARY SPLITS = 4
NUMBER OF SECONDARY SPLITS = 4
S4
NUMBER OF SECONDARY SPLITS = 0
S5
A = X/2
B = Y/2
C = Y/3
S9
N≦3
NO
YES
S10
X<A
YES
NO
S11
Y<B
NO
YES
S12
Y<B
NO
YES
S15
QUADRANT(III) CONTAINS CURSOR
S14
QUADRANT (II) CONTAINS CURSOR
S16
QUADRANT (IV) CONTAINS CURSOR
QUADRANT (I) CONTAINS CURSOR
S13
S17
N≦5
NO
YES
CALCULATION FOR IDENTIFYNG CURSOR CONTAINING QUADRANT
DISPLAY PRIORITY IS DETERMINED
TO APPLICATION

DISPLAY UNIT HAVING AN IMPROVED EDITING INPUT CAPABILITY

This application is a continuation of application Ser. No. 816,858 filed on Jan. 7, 1986, now abandoned.

BACKGROUND OF THE INVENTION

The present invention relates to a display unit such as a CRT (Cathode Ray Tube) for a word processor and, more specifically to a CRT display unit capable of multi-frame displaying.

While editing a document by a word processor, you may need to change the format or recall other sentences that have been already registered. To provide for these requirements, a need exists for display device that can change the display mode temporarily to replace the present picture with another one.

If the present picture has been entirely replaced, however, it becomes impossible to know the relationship between the former data and the new data. In this sense, it is desirable for the display device to present a plurality of pictures simultaneously in one frame. A multi-picture display called a multi-window has been introduced for this purpose. With the multi-window method, other pictures for temporary reference are shown in windows overlapping with the existing picture.

According to the conventional multi-window method, the window is shown on or overlapping the existing picture regardless of the position of the cursor, thus interfering with any editing input operations.

SUMMARY OF THE INVENTION

Accordingly, it is an object of the present invention to provide a display unit such as a CRT in which a window is presented at a position which does not disturb an editing input operation.

Another object of the present invention is to provide a display unit such as a CRT in which a window is presented at a specified position remote from the cursor, but overlapping with the existing picture on the CRT.

Other objects and further scope of applicability of the present invention will become apparent from the detailed description given hereinafter. It should be understood, however, that the detailed description and specific examples, while indicating preferred embodiments of the invention, are given by way of illustration only. Various changes and modifications within the spirit and scope of the invention will become apparent to those skilled in the art from this detailed description.

To achieve the above objects, the display unit of a preferred embodiment of the present invention displays another picture in a window at a prescribed position most remote from the cursor, but overlapping with the existing picture on the CRT.

BRIEF DESCRIPTION OF THE DRAWINGS

The present invention will be better understood from the detailed description given hereinbelow and the accompanying drawings which are given by way of illustration only, and thus are not limitative of the present invention in which:

FIGS. 1 and 2 are flow charts showing the operation sequence of an embodiment of the present invention;

FIG. 3 is a block diagram of the embodiment of the present invention;

FIG. 4 indicates the coordinates in the display area, of the cursor of the CRT display unit; and FIG. 5 through 8 show quadrants in the split display areas.

DETAILED DESCRIPTION OF THE INVENTION

An embodiment of the invention is now described with reference to the drawings.

According to the present invention, to display a second picture overlapping with the existing picture, the display area is split into portions and the most remote portion from the current cursor position is selected, with the top priority, as a window for the second picture, so that an editing input operation is not disturbed by the window with the second picture.

FIG. 3 is a block diagram of a word processor with the above-mentioned function. Reference numeral 1 is an editing controller that controls editing operation on the basis of data stored in an editing memory 2. Reference numeral 3 is a system program unit for editing, 4 is a keyboard for data input, 5 is a floppy disc for storing programs and edited sentences, 6 is a controller of the floppy disc 5, 7 is a CRT display unit, 8 is a controller of the CRT display unit 7, and 9 is a controller of a printer 10.

In the editing memory 2, 20 is a sentence buffer for storing presently edited sentence data, and 21 is a window buffer for storing data to be displayed in windows such as sentence data read from the floppy disc 5, message data for various formats needed in the window display mode, display-related luminance and inversion information data and frame-splitting quadrant data. Block 22 contains various buffers, counters and a controller for determining the above-mentioned top priority display quadrant.

Using the above circuit construction, the framesplitting operation is controlled as follows:

In FIG. 4, 1 is a CRT display unit for a word processor. X is the longitudinal dimension and Y is the horizontal dimension of the display area. Coordinates of a cursor 2 located on the "x"th line from the top and "y"th row from the left are indicated as (x,y).

FIG. 5 shows the CRT display unit 1 whose display area is split into four portions. Counterclockwise from the upper right, the four portions are identified as the first quadrant [I], the second quadrant [II], the third quadrant [III]and the fourth quadrant [IV], respectively. Thus, when the display area is split into four quadrants, up to three quadrants are available for windows unless windows are displayed overlapping with one another. A quadrant at the position of point symmetry with a quadrant containing the cursor 2 is selected for a display window with the first priority. The quadrant over or under the top priority quadrant is given the second priority, and the rest is given the third.

For instance, when the cursor 2 is in the third quadrant [III]as shown in FIG. 5, the priority order is [I], [IV]and [II].

FIG. 6 shows the CRT display unit 7 whose display area is split into six portions. Counterclockwisely from the upper right, the six portions are identified as the first [I]through the sixth [VI]quadrants, respectivley. Thus, when the display area is split into six quadrants, up to five quadrants are available for windows unless windows are displayed overlapping with one another. In this case, a quadrant most remote from that containing the cursor is given the top priority. When the cursor is in [IV], for instance, the priority order is [I], [VI], [II], [V]and [III]. When the cursor is in the center position such as in [II]or [V], a quadrant on the right is given the first priority as a rule. For example, when the cursor is in [II], the priority order is [VI], [I], [V], [IV]and [III]. In FIG. 7, all the quadrants other than the one containing the cursor are further split into four portions. Thus, when the number of primary splits is four and the number of secondary splits is four, up to 12 quadrants are available for display windows unless windows are displayed overlapping with one another. The priority of this case is generally in accordance with the rule for the case shown in FIG. 5. When the cursor 2 is in [III]as shown in FIG. 7, for instance, the priority order is $[I_1]$, $[I_4]$, $[I_2]$, $[I_3]$- $[IV_1]$, $[IV_4]$, $[IV_2]$, $[IV_3]$- $[II_1]$, $[II_4]$, $[II_2]$and $[II_3]$.

The number of quadrants available for windows may be increased by a similar repetition of splits.

FIG. 8 shows the frame divisions when windows overlap with one another. In this case as well, the priority of quadrants accords with the rule for the cases without overlapping windows. Unless window size is reduced, a window may not fit in a specified quadrant, thereby protruding into another quadrant. The window displayed last is given the first priority. The windows ①, ②, ③ and ④ in FIG. 8 have been displayed in this order. In principle, windows do not protrude into a quadrant where the cursor is located.

FIG. 1 is a flow chart showing the operation sequence in the editing memory 2 for identifying a cursor-containing quadrant.

The number of windows N is input in step Sl. If N is not larger than 3 in step S2, the sequence proceeds to step S3 where "4" is set for the number of primary splits. After "0" is set for the number of secondary splits, the sequence proceeds to step S5. If N is not smaller than 4 in step S2, the sequence proceeds to step S6. If N is 4 or 5 in step S6, "6" is set for the number of primary splits in step S7 before the sequence proceeds to step S4. If N is larger than 5 in step S6, "4" is set for the number of primary splits in step S8 and "4" is set for the number of secondary splits before the sequence proceeds to step S5 where X/2, Y/2 and Y/3 are set for A, B and C respectively. The values for X and Y correspond to the longitudinal and horizontal display area dimensions, respectively, of the CRT display unit 7. If N is not larger than 3 in step S9, the sequence proceeds to step S10. If the coordinate "x" of the cursor 2 is smaller than A, the sequence proceeds to step S11. If the coordinate "x" is larger than A, the sequence proceeds to step S12. If the coordinate "y" of the cursor 2 is smaller than B in step S11, it is determined in step S13 that the cursor 2 is located in the first quadrant [I]. If the coordinate "y" is larger than B in step S11, it is determined in step S14 that the cursor is located in the second quadrant [II]. If the coordinate "y" of the cursor 2 is smaller than B in step S12, it is determined in step S15 that the cursor is located in the third quadrant [III]- whereas, if the coordinate "y" is larger than B, it is determined in step S16 that the cursor is located in the fourth quadrant [IV]. The sequence proceeds from step S9 to step S17 when N is 4 or larger, and then proceeds to step S10 if N is 6 or larger. If N is 4 or 5, a quadrant where the cursor 2 is located is identified on the basis of the comparison between the coordinates of the cursor 2 and the settings for A (=X/2) and C (=Y/3).

When the cursor-containing quadrant is determined, the display priority of windows is accordingly determined by the editing controller 1.

FIG. 2 is a flow chart showing the operation sequence for selecting a particular quadrant for a window according to the display priority determined above. In step S20, the display quadrants are retrieved. Then in step S21, it is determined if there are vacant quadrants. If yes in step S21, a quadrant with the top priority is selected from among the vacant quadrants in step S22. If no in step S21, the quadrant of the lowest priority is selected in step S24. Then, the sequence proceeds to step S23 where the position data for the selected quadrant is stored in the window buffer 21 that preliminarily stores data to be displayed in each of the quadrants. In step S25, the data for the selected quadrant is transferred to that position of the display memory corresponding to the position data to replace the old data. Thus, the data is displayed in the window at a particular position.

When the particular window display mode operation has been completed, the data is read from the sentence buffer 20 into the display memory, so that the display unit presents the original picture.

According to the present invention, as understood from the above, when a second picture is to be displayed in a window overlapping with the existing picture displayed for editing, a display window most remote from the cursor position is selected for the second picture, thereby preventing the editing input operation from being disturbed. The display unit of the present invention is not limited to a CRT. It may be a liquid crystal display (LCD) or electroluminescence (EL) display device.

In the above description, when a window is displayed overlapping with the existing picture, the top priority is given to the quadrant most remote from the cursor position. Alternatively, data may be displayed in a window selected according to other rules. That is, assuming the display area is divided into a plurality of portions to display other data overlapping with the existing data displayed on the frame, any priority rule may be executed for selecting a particular portion that does not contain the cursor. While only certain embodiments of the present invention have been described, it will be apparent to those skilled in the art that various changes and modifications may be made therein without departing from the spirit and scope of the present invention as claimed.

What is claimed is:

1. A display unit for a word processor, comprising:
means for displaying current input data;
means for displaying recalled data;
means for dividing a reviewing screen of said display unit into a plurality of at least three display portions having a defined area when said current input data is displayed on said reviewing screen;
cursor means for controlling the location of data input on said reviewing screen of said display unit;
means for identifying one of said plurality of said display portions in which said cursor means is located;
means for selecting a remaining one of said plurality of display portions which does not contain said cursor means according to said means for identifying;
control means for displaying said recalled data in said selected one of said plurality of display portions, whereby said recalled data is displayed in a display portion most remote from said cursor means; and wherein said plurality of display portions are assigned a hierarchy of priorities, respectively, according to their location on said reviewing screen why with respect to said cursor means, said display portion having the highest priority being most remote from said cursor means.

2. A display unit as recited in claim 1, wherein said reviewing screen is divided into at least four display portions.

3. A display unit as recited in claim 1, wherein said reviewing screen is divided into at least six display portions.

4. A display unit as recited in claim 1, wherein said plurality of display portions includes primary display portions and secondary display portions, wherein each primary display portion is subdivided by said dividing means into said secondary display portions.

5. A display unit as recited in claim 1, wherein said plurality of display portions are in a non-overlapping relationship.

6. A display unit as recited in claim 1, wherein said plurality of display portions are in an overlapping relationship but are not in an overlapping relationship with the display portion containing said cursor means.

* * * * *